US005634288A

United States Patent [19]

Martel

[11] Patent Number: 5,634,288

[45] Date of Patent: Jun. 3, 1997

[54] ONE-PIECE GAS TUBE FOR SKS RIFLE

[76] Inventor: Phillip C. Martel, 43551 Applewood, Canton, Mich. 48188

[21] Appl. No.: 375,744

[22] Filed: Jan. 20, 1995

[51] Int. Cl.[6] ..... F41C 27/00

[52] U.S. Cl. ..... 42/71.01; 89/191.01

[58] Field of Search ..... 42/71.01; 89/14.1, 89/184, 191.01

[56] References Cited

U.S. PATENT DOCUMENTS

| | | | |
|---|---|---|---|
| 2,376,321 | 5/1945 | Albertson | 89/14.1 |
| 2,377,703 | 6/1945 | Loomis | 89/184 |

FOREIGN PATENT DOCUMENTS

| | | | |
|---|---|---|---|
| 70923 | 6/1942 | Czechoslovakia | 89/191.01 |
| 56071 | 4/1939 | Denmark | 89/191.01 |
| 308724 | 6/1930 | United Kingdom | 89/191.01 |

*Primary Examiner*—Michael J. Carone
*Attorney, Agent, or Firm*—Young & Basile, P.C.

[57] ABSTRACT

A replacement gas tube for an SKS rifle features unitary construction to provide increased rigidity and improved vibrational and heat transfer characteristics. The gas tube also features at least one area of increased wall thickness in the handguard region in which is formed a mounting hole to permit the detachable mounting of a hand guard or other accessories.

18 Claims, 3 Drawing Sheets

ONE-PIECE GAS TUBE FOR SKS RIFLE

FIELD OF THE INVENTION

The present invention relates to the SKS semi-automatic rifle, and more particularly to a replacement gas tube therefor.

BACKGROUND OF THE INVENTION

The SKS rifle, also known as the Simonov, is a semi-automatic rifle developed for the Soviet army in the 1940's. SKS type rifles have been in widespread use by military services around the world since that time, and are widely available as military surplus for civilian use in the U.S.

The firing mechanism of the SKS is automatically cocked each time a round of ammunition is fired by means of a piston which is actuated by the gas propelling the bullet out of the gun barrel. A small portion of the propellent gas exits the gun barrel through a port penetrating the barrel a short distance from the muzzle and enters a gas tube located above the barrel. The piston is located inside the gas tube and is driven in a rearward direction by the gas against a bolt carrier, momentarily driving the carrier rearwardly against a recoil spring to eject the spent shell casing and cock the hammer. The force of the gas is spent at this point, and the recoil spring drives the bolt carrier forward to introduce a new round from the magazine into the firing chamber.

The standard gas tube produced for SKS rifles is an assembly of several parts. The tube itself is formed in two pieces, the first being a piston tube having a relatively large interior diameter to permit sliding passage of the gas piston head therein, and the second being a rod tube having a smaller inside and outside diameter than the piston tube, with the inside diameter sized to permit passage of an operating rod attached to the gas piston head and the outside sized to permit it to be press fit into the bore of the piston tube. A hand guard, usually made of wood or metal, is attached to the gas tube assembly via end bands to cover the rod tube portion of the gas tube, which becomes hot during continuous firing of the rifle and which is located along the upper surface of the fore end of the stock where a hand may rest while holding a rifle. Standard hand guards comprise three separate pieces: a semi-cylindrical guard, and two end caps or bands which connect the guard to the gas tube.

The overall result of this multi-piece construction is a gas tube assembly that, while functioning adequately in its primary task of converting the energy of propellant gas into piston motion to actuate the firing mechanism, is relatively flexible over its longitudinal axis. This flexibility has several adverse consequences, the most significant being a reduction in firing accuracy of the rifle. The accuracy of firearms can generally be improved by increasing the stiffness or rigidity of the barrel and receiver group components, including the gas system components connected to the rifle barrel.

It is believed by the inventor that the multi-piece construction of the prior art gas tube also leads to the assembly having an increased number of harmonic natural frequencies that are excited when the rifle is fired. During rapid fire these harmonic vibrations may propagate throughout the rifle, decreasing accuracy and possibly causing metal fatigue that may lead to failure of any number of the rifle's components.

Additionally, the multi-piece gas tube has inherently poor heat transfer characteristics. The interface between the two tube patterns impedes heat transfer therebetween and so reduces the overall rate of heat dissipation from the unit.

Another limitation of the standard SKS gas tube assembly is that the hand guard portion cannot be readily detached from the gas tube. The hand guard may need replacement due to damage, or the gun owner may wish to install a different style or color hand guard. It may also be desirable to remove the hand guard from the gas tube assembly for cleaning. Currently, removal of the handguard from the gas tube cannot be accomplished without access to a well equipped machine shop.

The position of the gas tube assembly on the SKS rifle assembly is a prime spot for the mounting of non-standard rifle accessories, such as sighting devices, flashlights, or cameras. The construction of the standard gas tube, however, does not permit the secure mounting of such accessories. No provisions are made on the standard gas tube for mounting accessories, detachably or otherwise.

SUMMARY OF THE INVENTION

It is an object of the present invention to provide an improved gas tube for an SKS rifle formed from a single piece of metal. The increased stiffness of the unitary gas tube improves the overall rigidity of the rifle when the gas tube is operatively attached to the rifle, thereby increasing firing accuracy and reducing vibration during firing. The heat transfer characteristics of the unitary tube are also improved.

It is a further object of the present invention to provide an SKS rifle gas tube to which a hand guard or other accessory may be securely yet removably attached. This objective is achieved by providing an axial segment of the gas tube in the handguard region with a mounting site, for example by increasing wall thickness enough to allow the formation therein of mounting holes. By the use of bolts or other fastening means, a hand guard or other accessory can be securely attached to the gas tube and thereby to the rifle as a whole and may be easily removed for repair or replacement.

It is yet another object of the present invention to provide an SKS rifle gas tube of unitary construction having increased axial rigidity wherein cooling of the gas tube is enhanced by a plurality of integrally formed, axially spaced cooling fins.

DETAILED DESCRIPTION OF THE PREFERRED EMBODIMENT

Figures 1, 2:
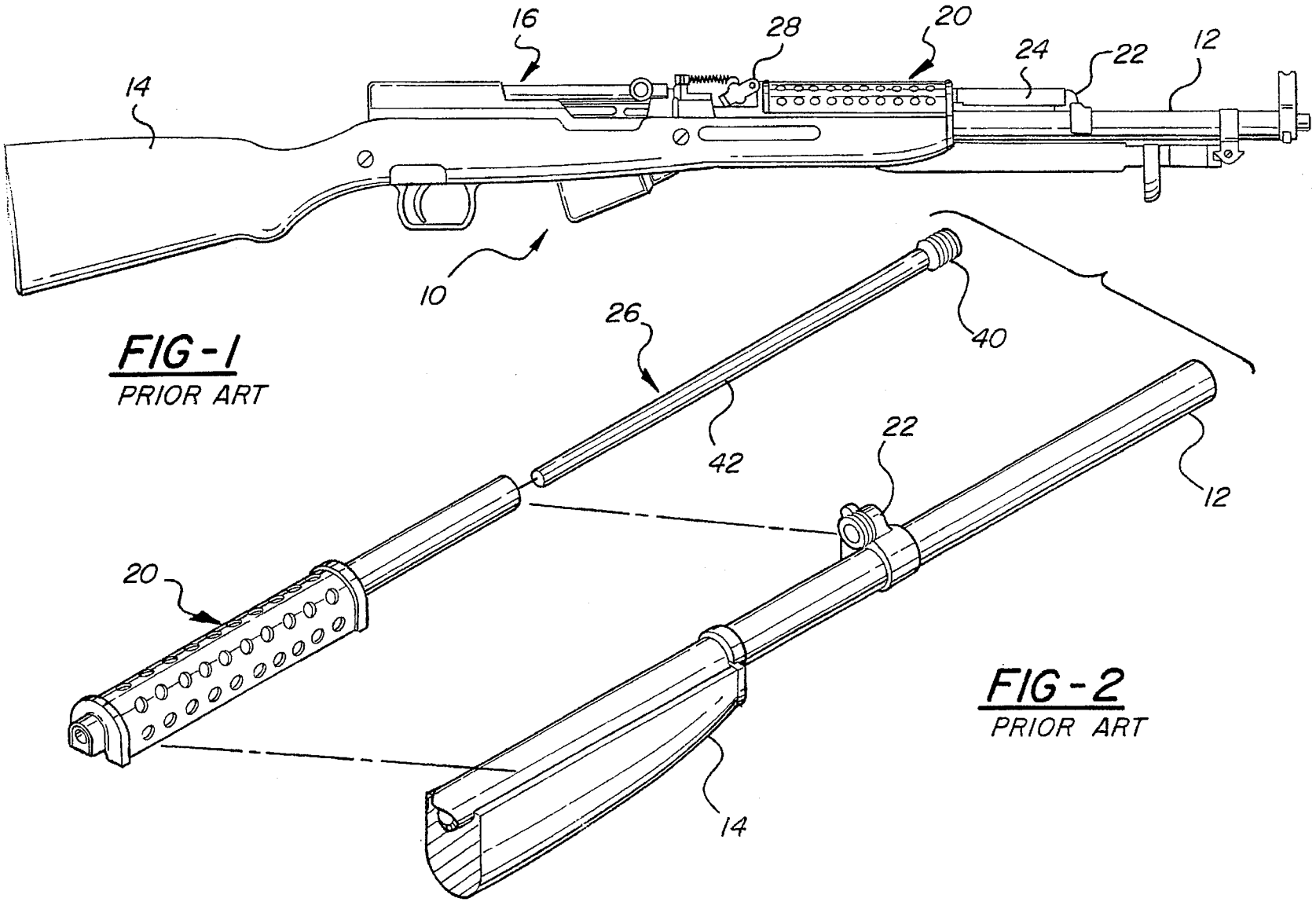
FIG-1 PRIOR ART
FIG-2 PRIOR ART
FIG. 1 is a right side view of an SKS rifle of the type toward which the present invention is directed.
FIG. 2 is a perspective view of a prior art gas tube and handguard assembly shown with cooperating parts of the rifle and the gas piston removed.

As depicted in FIG. 1, an SKS rifle 10 generally comprises a barrel 12, a stock 14, a receiver 16, and a gas tube assembly 20. The receiver 16 houses several parts which together make up the rifle firing mechanism (partially shown). A small diameter hole (not shown) passes through the upper wall of barrel 12 and is covered by gas cylinder 22. When rifle 10 is fired, a small portion of the combustion gas which propels a bullet along barrel 12 escapes through the gas port and into the gas cylinder after the bullet has passed thereby. Gas cylinder 22 is in communication with a gas tube 24 such that the gas enters gas tube 24 and acts on a gas piston 26 slidingly contained therein. Gas piston 26 has a rod portion 42 which extends out the rear end of gas tube 24 and into receiver 16 where it operatively engages the firing mechanism in known manner. Each time rifle 10 is fired, the vented propellant gas forces gas piston 26 rearwardly in gas tube 24 and this motion actuates the firing mechanism to eject a spent shell casing, cock the firing mechanism, and load a new shell into the chamber of barrel 12.

Gas tube assembly 20 is retained in its operative position by engaging gas cylinder 22 at its forward end and a gas tube lock lever 28 at its rearward end. Gas tube assembly 20 may be removed from rifle 10 by moving gas tube lock lever 28 to an unlocked position and moving gas tube assembly 20 upwardly and rearwardly to disengage it from gas cylinder 22.

Figure 3:
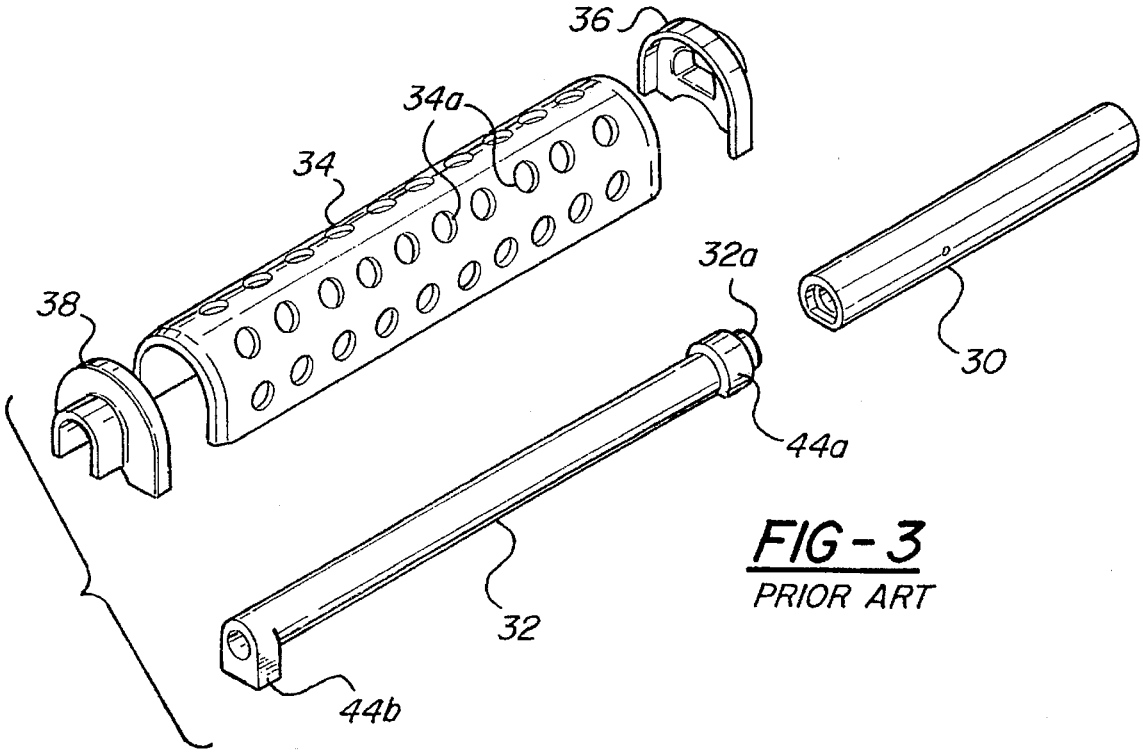
FIG-3 PRIOR ART
FIG. 3 is an exploded view of a prior art gas tube and handguard assembly for an SKS rifle.

A standard gas tube assembly for an SKS rifle exemplifying the prior art is shown in FIGS. 2 and 3. The prior art gas tube assembly comprises a piston tube 30, a rod tube 32, a hand guard 34, and forward and rear gas tube bands 36 and 38, respectively. Piston tube 30 has an interior bore of a diameter sized to receive piston head portion 40 (FIG. 2) of gas piston 26. Rod tube 32 has a smaller internal bore diameter than piston tube 30 for passage of rod portion 42 of gas piston 26. The external diameter of rod tube 32 is also substantially less than that of piston tube 30, and rod tube end 32*a* is press fit into the internal bore of piston tube 30 such that the respective piston and rod tube bores communicate in coaxial fashion.

Gas tube bands 36, 38 engage opposite ends of hand guard 34, with forward gas tube band 36 being press fit over forward assembly lug 44*a* on rod tube 32 and abutting piston tube 30, and rear gas tube band 38 being welded and/or pinned to an assembly lug 44*b* formed at the rearward end of rod tube 32. Handguard 34 is held between bands 36, 38 and assembly lugs 44*a*, 44*b* to cover rod tube 32 and prevent it from directly contacting a user's hand during firing. Handguard 34 is perforated with holes 34*a* to keep it cool.

The two-piece nature of the prior art gas tube reduces its strength and rigidity, particularly where rod tube 32 and piston tube 30 are joined. Additionally, the press-fit and braze/weld attachment of handguard 34 to rod tube 32 via bands 36, 38 and assembly lugs 44 makes removal of handguard 34 from the gas tube very difficult without special tools or machinery. Finally, the three-piece band/handguard assembly 34, 36, 38 adds additional non-unitary structure to the gas tube when assembled therewith.

Figure 4:
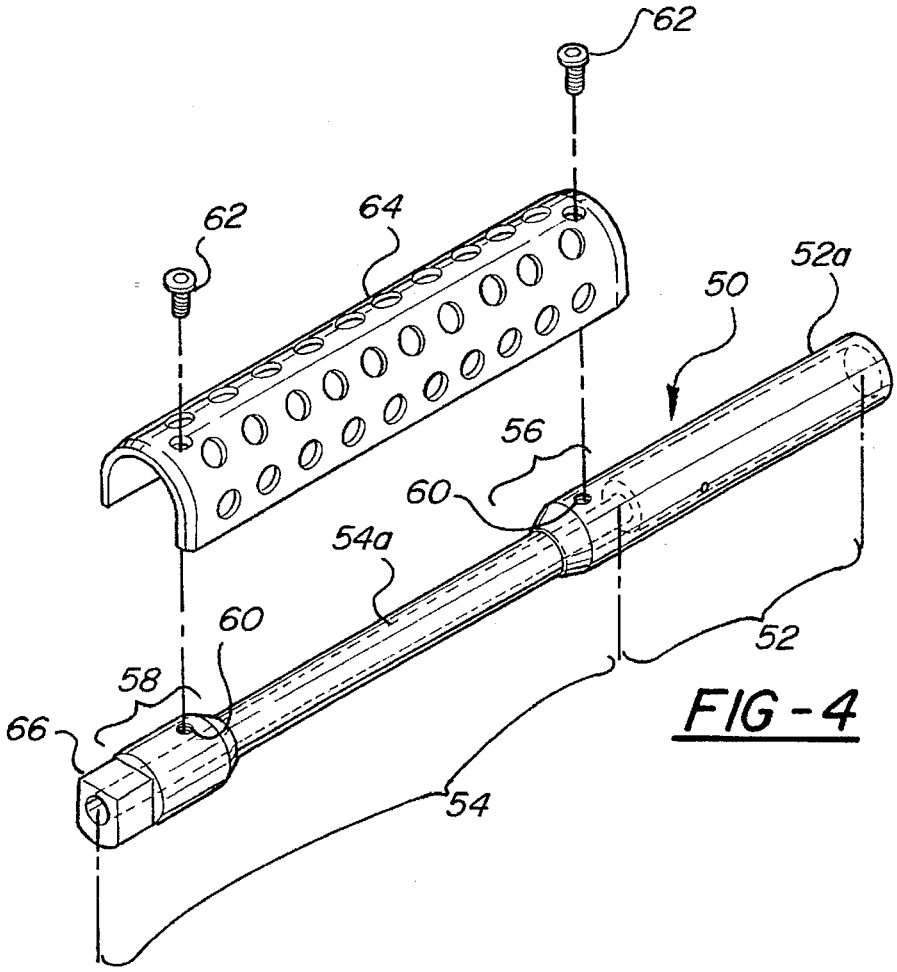
FIG. 4 is an exploded view of an SKS gas tube and handguard assembly embodying the present invention.

In the improved gas tube of the present invention shown in FIG. 4, gas tube 50 is unitary, formed from a single piece of metal, preferably carbon steel. The forward end of unitary gas tube 50, that being defined as the end which engages gas cylinder 22, comprises a piston tube portion 52 having a bore 52*a* of a diameter sized to receive the head 40 of gas piston 26. The balance of gas tube 50 defines a rod tube portion 54 having a bore 54*a* of a diameter smaller than that of piston tube portion 52 and sized to receive the rod 42 of gas piston 26. The rearmost end of rear tube portion 54 includes an assembly lug 66 which is similar to lug 44*b* in FIG. 3; i.e., it is engaged by gas tube lock lever 28 to hold gas tube 50 securely in its operative position on rifle 10.

The one piece, unitary construction of gas tube 50 according to the present invention increases its rigidity, thereby increasing accuracy of the rifle to which it is connected. In particular, the two piece plug fit of the prior art rod tube 32 and piston tube 30 is replaced with a unitary rod tube 54 and piston tube 52, in which the junction of rod bore 54*a* and piston bore 52*a* is strengthened by a unitary region of increased wall thickness 56 which overlies the forward end of rod bore 54*a* and is integral with piston tube 52. At the same time, the increased wall thickness of rod tube region 56 provides a solid, convenient mounting site for an accessory such as handguard 64. In the illustrated embodiment at FIG. 4, forward mounting lug region 56 is provided with a threaded hole 60 for receiving a set screw 62 for securing handguard 64 directly to the gas tube 50, without the need for structure such as bands 36, 38.

In a preferred form the rearward end of rod portion 54 of gas tube 50 includes an enlarged diameter region or lug 58 which provides a rearward mounting site for the rear end of handguard 64, also using a threaded hole 60 and set screw 62.

The intermediate region of rod tube portion 54 between mounting lugs 56, 58 has a reduced diameter to lighten the overall weight of gas tube 50. In the illustrated embodiment, however, the diameter of the intermediate portion of rod tube portion 54 is greater than the wall thickness of prior art rod tube 32 to increase rigidity and add a desirable, recoil-reducing heft near the mid-section of the rifle. It will be understood that various wall thicknesses can be used for the intermediate portion of rod portion 54, and it is possible to manufacture rod portion 54 with a constant diameter such that the entire gas tube 50 has a constant outside diameter. However, in the handguard region of rod tube portion 54 (i.e., the portion from the rear end of mounting lug 58 to the front end of mounting lug 56 covered by handguard 64) handguard 64 only contacts the gas tube in the region of mounting lug 56, 58. It is desirable to reduce the intermediate portion of rod portion 54 between mounting lugs 56, 58 to maintain an air gap with handguard 64; otherwise, handguard 64 might become uncomfortably hot through conductive, metal-on-metal heating along its entire length.

While in the illustrated embodiment of FIG. 4 a handguard 64 is the accessory attached to mounting lug regions 56, 58 of rod portion 54 of the gas tube, other accessories can be mounted to one or both of the mounting lug regions for example a flashlight bracket, a telescopic sight, a night sight, or a camera. And while the illustrated handguard 64 comprises a perforated metal, the handguard could be solid and/or made from other materials such as wood or heat-resistant plastics.

While the structure used for mounting the handguard accessory 64 to mounting lug regions 56, 58 comprises a threaded hole 60 and set screw fastener 62 in the illustrated embodiment, it will be apparent to those skilled in the art that mounting lug regions 56, 58 provide a strong base for other types of fastening or mounting structure to connect accessories to the gas tube assembly. The set screw fastened handguard 64 in the illustrated embodiment of FIG. 4 illustrates a preferred accessory, and a method for making it easily removed from gas tube 50 using only hand tools and without the need for removing gas tube 50 from rifle 10.

Figure 5:
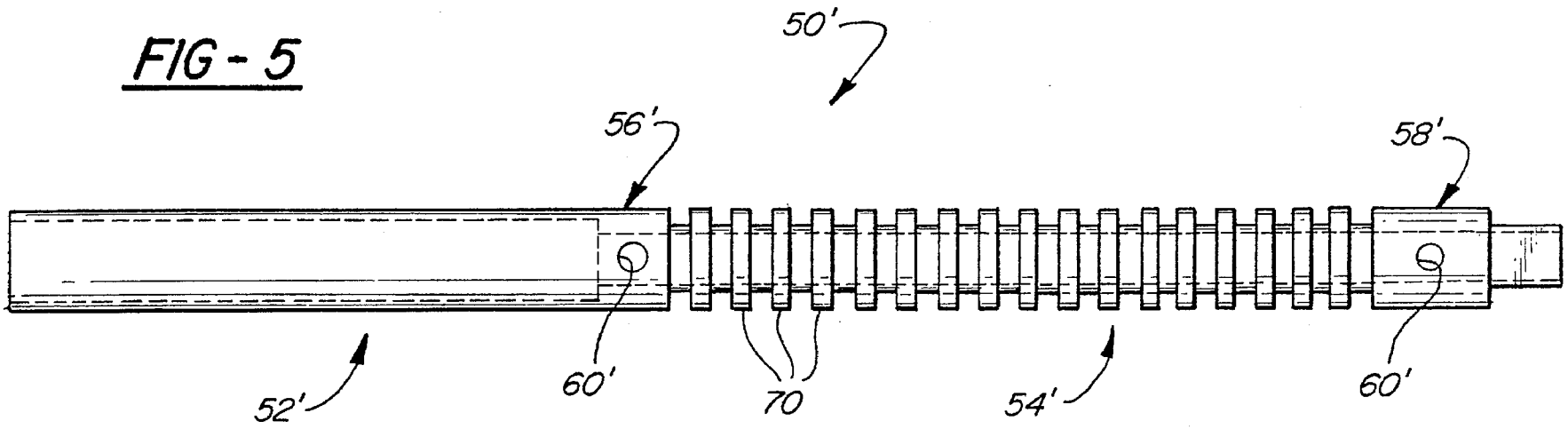
FIG. 5 is a side view of an SKS gas tube according to an alternate embodiment of the present invention.

A further embodiment of the present invention is depicted in FIG. 5 and comprises a unitary gas tube 50' having an overall configuration similar to that of the above-described first embodiment. Unitary gas tube 50' comprises a piston tube portion 52' and a rod tube portion 54' having mounting lug regions 56', 58' and a series of cooling fins 70 formed integrally therewith. Cooling fins 70 serve to increase the rate of heat transfer away from unitary gas tube 50' and also provide additional material to increase gas tube rigidity and serve as a heat sink. Gas tube 50' can be used with or without a handguard; however, where the diameter of fins 70 is equal to that of regions 56', 58', it may be preferable to dispense with a handguard for the reasons described above.

Many modifications and variations of the present invention will be apparent to those skilled in the art in light of the above teachings, and the described embodiments are not intended to limit the present invention beyond the scope of the claims.

I claim:

1. A replacement gas tube for an SKS rifle, the gas tube comprising:

integral piston and rod tube portions, the piston tube portion being of greater diameter and having a bore sized to operatively fit an SKS gas piston head, the rod tube portion being of lesser diameter and having a bore sized to operatively fit an SKS gas piston rod, the rod tube portion having a handguard region normally covered by a handguard when the gas tube is assembled to an SKS rifle, wherein the junction of the rod bore and piston bore is strengthened by a solid region of increased wall thickness comprising an integral extension of the piston tube portion overlying the rod bore in the handguard region of the rod tube portion and having a mounting hole therein for the attachment of a handguard or accessory in the handguard region.

2. The gas tube of claim 1, wherein the wall thickness of the rod tube portion along its entire length is greater than a standard SKS rod tube portion.

3. A replacement gas tube for an SKS rifle, the gas tube comprising:

integral piston and rod tube portions, the piston tube portion having a bore sized to operatively fit an SKS gas piston head, the rod tube portion having a bore sized to operatively fit an SKS gas piston rod, the rod tube portion having a handguard region normally covered by a handguard when the gas tube is assembled to an SKS rifle, the handguard region of the rod tube portion including a region of wall thickness greater than a standard SKS rod tube portion capable of receiving a mounting hole therein for the attachment of a handguard or accessory in the handguard region wherein the rod tube portion includes mounting lugs at each end of the rod tube portion in the handguard region, each mounting lug having a mounting hole formed therein.

4. The gas tube of claim 3, wherein the mounting lugs are cylindrical and have an outside diameter approximately equal to the outside diameter of the piston tube portion.

5. The gas tube of claim 3, wherein the mounting lugs have a first greater diameter, and the rod tube has an intermediate portion between the mounting lugs whose diameter is less than the mounting lugs such that an air gap is maintained between the intermediate portion and a handguard when the handguard is attached to the mounting lugs.

6. The gas tube of claim 5, wherein the mounting lugs are of a diameter approximately equal to the diameter of the piston tube portion of the gas tube.

7. The gas tube of claim 6, wherein the intermediate portion of the rod tube is of a diameter less than the mounting lugs and has a greater wall thickness than the rod tube portion of a standard SKS gas tube.

8. The gas tube of claim 5, wherein the intermediate portion of the rod tube includes a plurality of integral cooling fins.

9. The gas tube of claim 8, wherein the diameter of the cooling fins is approximately equal to that of the mounting lugs and the piston tube portion of the gas tube.

10. A replacement gas tube for an SKS rifle, the gas tube comprising:

a piston tube portion having an internal bore sized to operatively fit an SKS gas piston head; and a rod tube portion integrally formed with and coaxially aligned with the piston tube portion, having an internal bore sized to operatively fit a standard SKS gas piston rod and comprising a first end segment adjacent the piston tube portion, a second end segment opposite therefrom, and a center segment located between the first and second end segments and having a substantially uniform external diameter and a wall of substantially uniform thickness, the first and second end segments having external diameters greater than the center segment external diameter such that the first and second end segments have walls of substantially greater thickness than the center segment wall, the first end segment wall has formed therein at least one blind mounting hole and the second end segment wall has formed therein at least one blind mounting hole, the mounting holes providing means to detachably mount accessories to the gas tube.

11. The gas tube of claim 10 wherein the mounting holes are threaded to receive bolts.

12. The gas tube of claim 10 further including a hand guard detachably mounted to the gas tube by means of the mounting holes.

13. A replacement gas tube and hand guard assembly for an SKS rifle, comprising:

a first gas tube portion having an internal diameter sized to operatively fit a standard SKS gas piston head; and a second tube portion integrally formed with and coaxially aligned with the first tube portion, having an internal diameter sized to operatively fit a standard SKS gas piston rod and comprising a first end segment adjacent the first tube portion, a second end segment opposite therefrom, and a center segment located between the first and second tube portions and having a substantially uniform external diameter and a wall of substantially uniform thickness, the first and second end segments having external diameters greater than the center segment external diameter such that the first and second end segments have walls of substantially greater thickness than the center segment wall, the first end segment wall having formed therein at least one blind mounting hole and the second end segment wall having formed therein at least one blind mounting hole; and a hand guard detachably mounted to the gas tube by fastening means engaging the mounting holes.

14. The gas tube and hand guard assembly of claim 13 wherein the hand guard is a single piece of metal having a plurality of cooling holes formed therein.

15. The gas tube and hand guard assembly of claim 13 wherein the hand guard is formed of a plastic material.

16. A unitary replacement gas tube for an SKS rifle, the gas tube comprising:

a first tube portion having an internal diameter sized to operatively fit a standard SKS gas piston head and a substantially uniform external diameter; and a second tube portion integrally formed with and coaxially aligned with the first tube portion, having an internal diameter sized to operatively fit a standard SKS gas piston rod and comprising a first end segment, a second end segment, and a center segment located therebetween, the first and second end segments having external diameters substantially equal to the external diameter of the first tube portion, and the center segment having a first external diameter substantially less than the external diameter of the first tube portion and having a plurality of axially spaced cooling fins extending radially therefrom and defining a second external diameter.

17. The unitary replacement gas tube of claim 16 wherein the second external diameter of the center segment of the second tube portion is substantially equal to the external diameter of the first tube portion.

18. The unitary replacement gas tube of claim 16 further including at least one mounting hole formed in the first end segment and at least one mounting hole formed in the second end segment.

* * * * *